US008944573B2

(12) United States Patent
Yokoyama et al.

(10) Patent No.: US 8,944,573 B2
(45) Date of Patent: Feb. 3, 2015

(54) INKJET HEAD AND METHOD OF MANUFACTURING THE SAME

(71) Applicant: Toshiba Tec Kabushiki Kaisha, Shinagawa-ku, Tokyo (JP)

(72) Inventors: Shuhei Yokoyama, Shizuoka-ken (JP); Ryutaro Kusunoki, Shizuoka-ken (JP); Chiaki Tanuma, Tokyo-to (JP); Ryuichi Arai, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/777,105

(22) Filed: Feb. 26, 2013

(65) Prior Publication Data

US 2013/0222484 A1 Aug. 29, 2013

(30) Foreign Application Priority Data

Feb. 27, 2012 (JP) ..... 2012-039615

(51) Int. Cl.

*B41J 2/45* (2006.01)
*B41J 2/14* (2006.01)
*B41J 2/16* (2006.01)

(52) U.S. Cl.

CPC ..... *B41J 2/14201* (2013.01); *B41J 2/1607* (2013.01); *B41J 2/1623* (2013.01); *B41J 2/1628* (2013.01); *B41J 2/1631* (2013.01); *B41J 2/1632* (2013.01); *B41J 2/1642* (2013.01); *B41J 2/1643* (2013.01); *B41J 2/1645* (2013.01); *B41J 2/1646* (2013.01); *B41J 2002/1437* (2013.01); *B41J 2202/15* (2013.01)

USPC ..... 347/70

(58) Field of Classification Search

USPC ..... 347/70

See application file for complete search history.

(56) References Cited

U.S. PATENT DOCUMENTS

| | | | | |
|---|---|---|---|---|
| 5,889,539 | A * | 3/1999 | Kamoi et al. | 347/50 |
| 7,843,113 | B2 * | 11/2010 | Wijngaards et al. | 310/320 |
| 8,608,296 | B2 | 12/2013 | Nakatani | |
| 2011/0037813 | A1 * | 2/2011 | Nakatani | 347/70 |
| 2012/0056947 | A1 | 3/2012 | Tanuma et al. | |

FOREIGN PATENT DOCUMENTS

| | | | | |
|---|---|---|---|---|
| JP | 03-065350 | | 3/1991 | |
| JP | 10-058672 | | 3/1998 | |
| JP | 10-058672 | A * | 3/1998 | B41J 2/015 |

* cited by examiner

*Primary Examiner* — Stephen Meier
*Assistant Examiner* — Alexander D Shenderov
(74) *Attorney, Agent, or Firm* — Amin, Turocy & Watson, LLP

(57) ABSTRACT

According to an embodiment, an inkjet head includes a nozzle from which ink is ejected, an ink pressure chamber, an oscillating plate, a first electrode, a piezoelectric layer, a second electrode, and a passivation layer. The ink pressure chamber is provided in the inkjet head to supply ink to the nozzle. The oscillating plate is formed to surround the nozzle. The first electrode is formed to surround the nozzle and to be in contact with the first oscillating plate. The piezoelectric layer is configured to surround the nozzle and to be in contact with the first electrode. The second electrode is formed to surround the nozzle and to be in contact with the piezoelectric layer. The passivation layer is formed to surround the nozzle and to be in contact with the first electrode, the second electrode, or the first oscillating plate.

8 Claims, 19 Drawing Sheets

INKJET HEAD AND METHOD OF MANUFACTURING THE SAME

CROSS-REFERENCE TO RELATED APPLICATION

This application is based upon and claims the benefit of priority from the prior Japanese Patent Application No. 2012-39615 filed on Feb. 27, 2012, the entire contents of which are incorporated herein by reference.

FIELD

Embodiments described herein relate generally to an inkjet head that ejects ink from nozzles and forms an image on recording media and a method of manufacturing the inkjet head.

BACKGROUND

There is known an on-demand type inkjet recording system for ejecting ink droplets from nozzles according to an image signal and forming an image with the ink droplets on a recording paper. The on-demand type inkjet recording system mainly includes a heat generating element type head and a piezoelectric element type head. The heat generating element type head is constituted to energize a heat generating element provided in an ink channel to generate air bubbles in ink and eject the ink pushed by the air bubbles from nozzles. The piezoelectric element type head is constituted to eject ink stored in an ink chamber from nozzles by utilizing deformation of a piezoelectric element.

The piezoelectric element converts a voltage into force. When an electric field is applied to the piezoelectric element, the piezoelectric element causes extension or shear deformation. As a representative piezoelectric element, a lead-zirconate-titanate is used.

As an inkjet head that utilizes the piezoelectric element, a constitution including a nozzle board formed of a piezoelectric material is known. In this inkjet head, electrodes are formed on both surfaces of the piezoelectric nozzle board to surround nozzles that eject ink. The ink enters between the nozzle board and a substrate that supports the nozzle board. The ink forms meniscuses in the nozzles and is maintained in the nozzles. If a high frequency voltage is applied to the electrodes, the nozzle board is oscillated and oscillation energy is radiated from the circumferential edge of the nozzle toward the center thereof. The oscillation energy is concentrated to the center of the nozzle and thus energy is generated in the direction normal to the surface of the ink, resulting in jetting an ink droplet from the nozzle.

DETAILED DESCRIPTION

Figure 1:
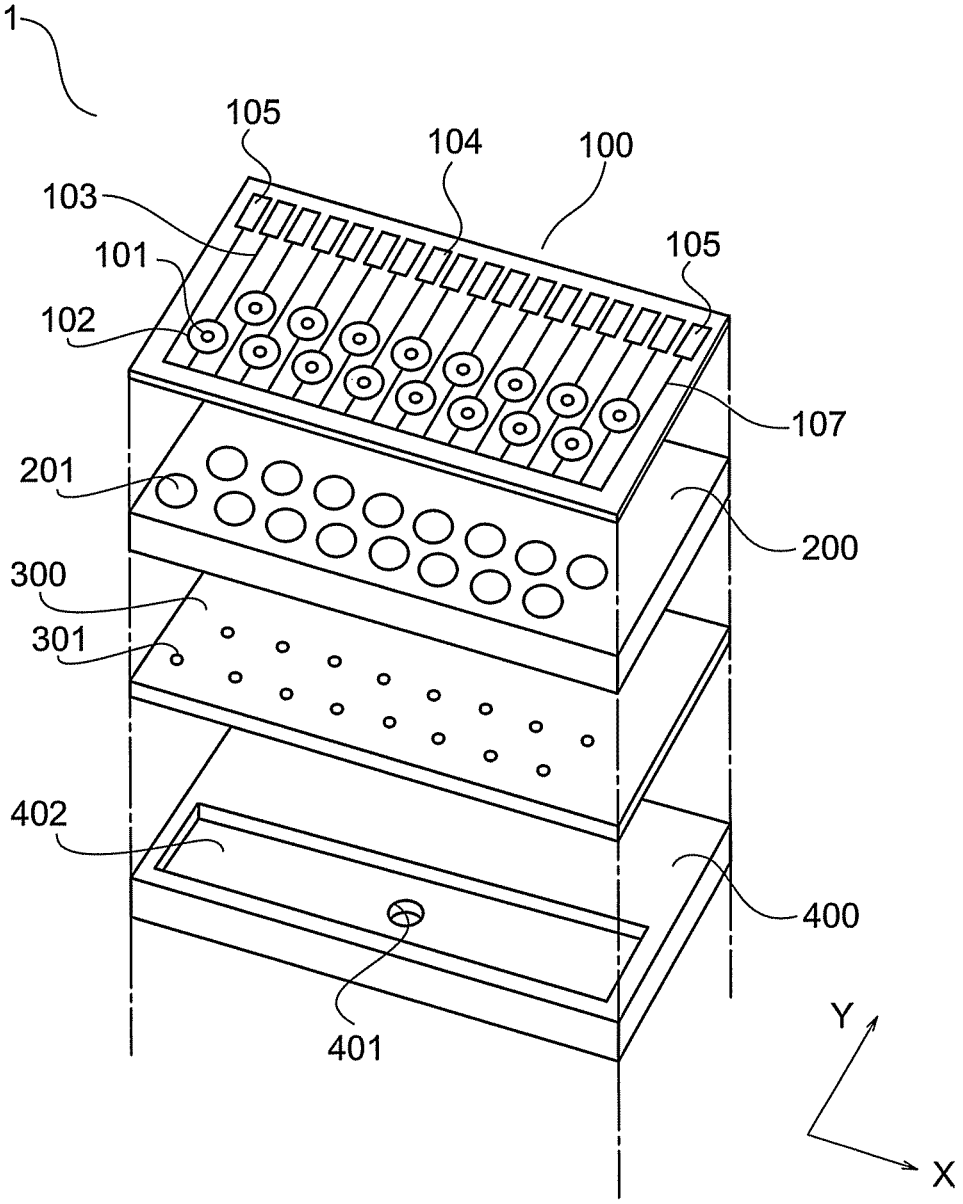
FIG. 1 is an exploded perspective view illustrating an inkjet head in case that ink in an ink supply path 402 is not circulated according to a first embodiment.

According to an embodiment, an inkjet head includes a nozzle through which ink is ejected, an ink pressure chamber for supplying ink to the nozzle, an oscillating plate surrounding the nozzle, a first electrode, surrounding the nozzle, which is in contact with the first oscillating plate, a piezoelectric layer, surrounding the nozzle, which is in contact with the first electrode, a second electrode, surrounding the nozzle, which is in contact with the piezoelectric layer, and a passivation layer, surrounding the nozzle, which is in contact with the first electrode, second electrode, or first oscillating plate.

Embodiments are explained below with reference to the accompanying drawings, in which same reference numerals are applied to similar structures in the drawings.

First Embodiment

FIG. 1 is an exploded perspective view of an inkjet head according to a first embodiment.

The inkjet head 1 shown in FIG. 1 includes a nozzle plate 100, an ink pressure chamber structure 200, a separate plate 300, and an ink supply path structure 400.

The nozzle plate 100 includes plural nozzles 101 for ink ejection (ink ejection holes) that respectively penetrate through the nozzle plate 100 in the thickness direction thereof.

The ink pressure chamber structure 200 includes plural ink pressure chambers 201 respectively corresponding to the plural nozzles 101. One ink pressure chamber 201 is fluidly communicated with nozzle 101 corresponding thereto.

The separate plate 300 includes ink chokes 301 respectively communicating with the ink pressure chambers 201 formed in the ink pressure chamber structure 200. Each of the ink chokes 301 serves as an opening to supply ink from an ink supply path 402 described later to the ink pressure chamber 201.

In other words, the ink pressure chambers 201 and the ink chokes 301 are provided corresponding to the plural nozzles 101, respectively. The plural ink pressure chambers 201 are fluidly communicated with an ink supply path 402 through the ink chokes 301.

Each of the ink pressure chambers 201 stores ink for printing an image on a print medium, e.g., paper, plastic film, and so on. A pressure change or variation occurs in the ink contained in the ink pressure chambers 201 according to deformation of a portion of the nozzle plate 100 corresponding to the ink pressure chamber 201 and the ink is ejected from the nozzles 101. At this point, the ink choke 301 arranged in the separate plate 300 functions to confine the pressure generated in the ink into the ink pressure chamber 201 and to prevent the pressure from leaking to the ink supply path 402. Therefore, the diameter of the ink choke 301 is equal to or smaller than a quarter of the diameter of the ink pressure chamber 201.

The ink supply path 402 is provided in the ink supply path structure 400. An ink supply port 401 for supplying ink from the outside of the inkjet head 1 is provided in the ink supply path structure 400. The ink supply path 402 surrounds all the plural ink pressure chambers 201 such that ink can be supplied to all the ink pressure chambers 201. Namely, the ink supply path 402 is sized such that ink is supplied to all the ink pressure chambers 201 at the same time via the respective ink chokes 301.

The ink pressure chamber structure 200 is made, for example, of a silicon wafer having thickness of 725 μm. Each of the ink pressure chambers 201 is formed, for example, in a cylindrical shape having a diameter of 240 μm. Each nozzle 101 is provided along the centerline of the cylindrical shape of the ink pressure chamber 201.

The separate plate 300 is made, for example, of stainless steel having thickness of 200 μm. The diameter of the ink chokes 301 is set to, for instance, 50 μm. The ink chokes 301 are shaped such that fluid resistances of the ink chokes to the respective ink pressure chambers 201 are substantially the same.

Incidentally the ink choke 301 can be removed if the diameter or depth of the ink pressure chamber 201 is adequately designed. Even if the ink separate plate 300 having the ink choke 301 is not built in the inkjet head 1, ink can be ejected from the inkjet head 1.

The ink supply path structure 400 is made, for example, of stainless steel having thickness of 4 mm. The ink supply path 402 is provided at depth of 2 mm from the surface of the stainless steel. The ink supply port 401 is provided in substantially the center of the ink supply path 402.

Figure 2:
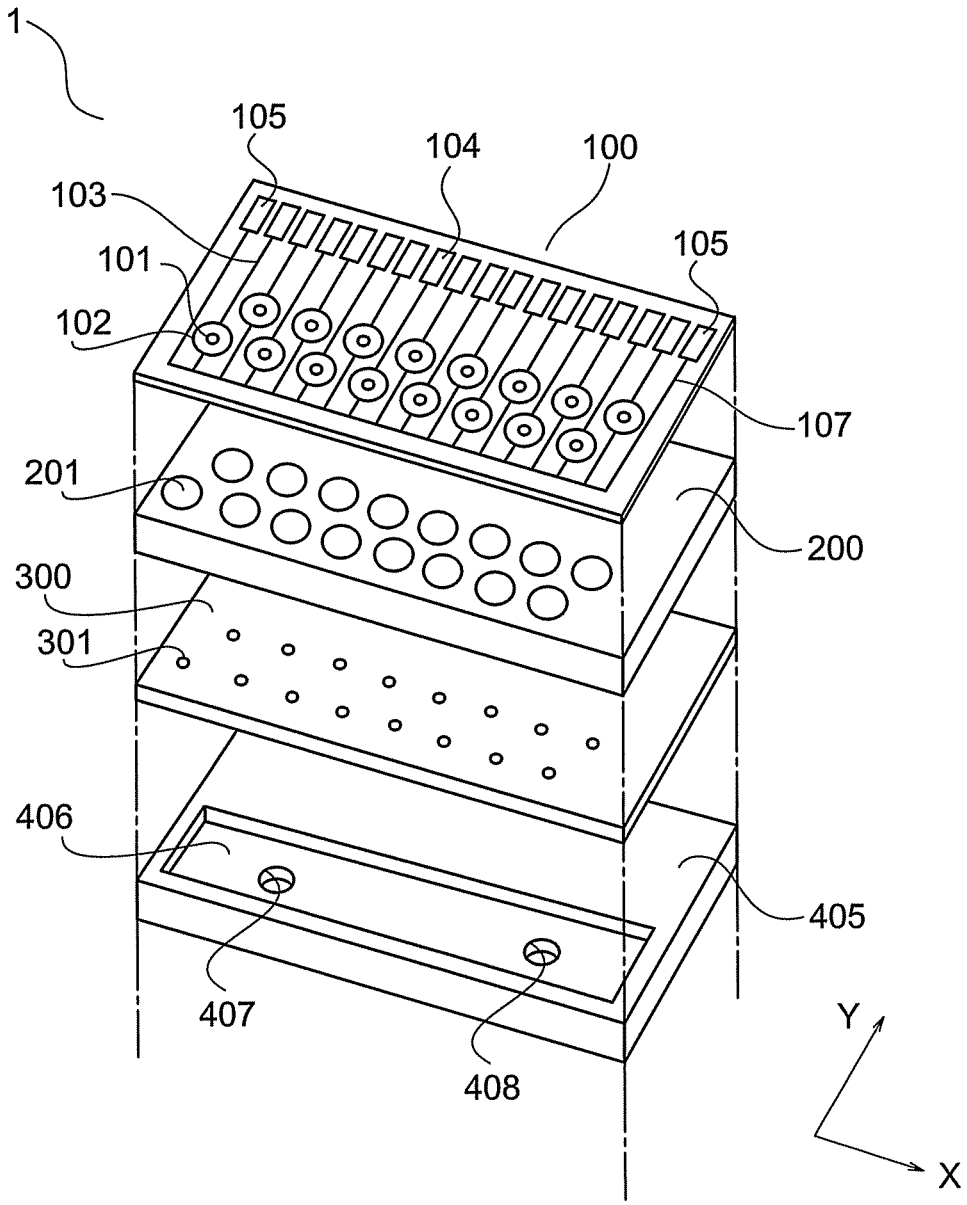
FIG. 2 is an exploded perspective view illustrating the inkjet head in case that ink in the ink supply path 406 is circulated according to the first embodiment.

FIG. 2 illustrates an inkjet head 1 having a second ink supply path structure 405 different from the ink supply path structure 400 shown in FIG. 1. The second ink supply path structure 405 has a second ink supply path 406 including a circulating ink supply port 407 and a circulating ink discharge port 408. The circulating ink supply port 407 and the circulating ink discharge port 408 are respectively arranged near opposite ends of the second ink supply path 406 such that the ink is circulated through the second ink supply path 406. Except the second ink supply path 406, the inkjet head 1 illustrated in FIG. 2 is made similar to the inkjet head 1 illustrated in FIG. 1.

Since the ink circulates, ink temperature in the second ink supply path 406 can be kept constant. Therefore, compared with the inkjet head shown in FIG. 1, it can achieve an effect that a temperature rise in the inkjet head due to heat generated by deformation of the nozzle plate 100 is suppressed.

The nozzle plate 100 provided to the inkjet head 1 illustrated in FIG. 1 or 2 has an integral structure in which the nozzle plate 100 is formed on the ink pressure chamber structure 200 with a thin film forming process explained later.

The ink pressure chamber structure 200, the separate plate 300, and the ink supply path structure 400 (the second ink supply path structure 405) are fixed, for example, by epoxy adhesive such that the nozzles 101 and the ink pressure chambers 201 keep a predetermined positional relation in one another.

The ink pressure chamber structure 200 can be made of a silicon wafer and the separate plate 300 and the ink supply path structure 400 can be made of stainless steel, for example. However, the materials of the structures 200, 300, and 400 are not limited to the silicon wafer and stainless steel. The structures 200, 300, and 400 are also possible to use other materials taking into account differences between coefficients of expansion of the materials and the coefficient of expansion of the nozzle plate 100 as long as the materials do not affect the ink ejection pressure generated in the ink pressure chamber 201. For example, as a ceramic material, nitrides and oxides e.g., alumina, zirconia, silicon carbide, silicon nitride, and barium titanate, can be used. As a resin material, plastic materials such as ABS (acrylonitrile butadiene styrene), polyacetal, polyamide, polycarbonate, and polyether sulfone can also be used. A metal material (alloy) can still also be used. Representative metal materials can include aluminum, titanium and their respective alloys.

Figure 3:
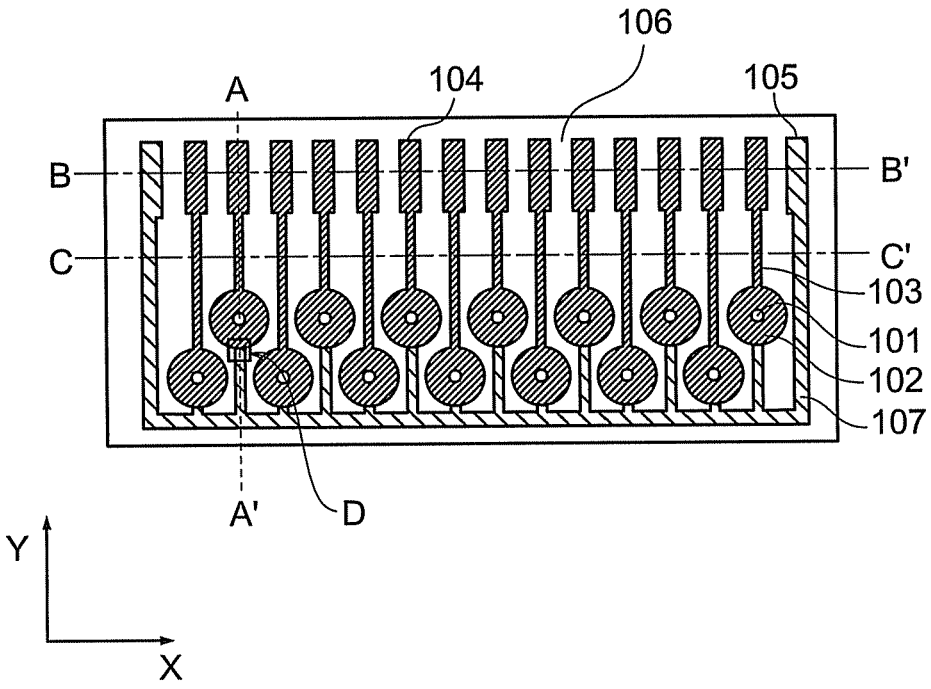
FIG. 3 is a plan view of the inkjet head according to the first embodiment.
Figure 4A:
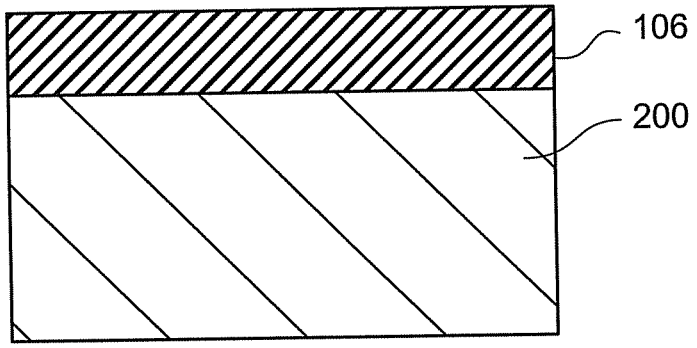
FIGS. 4(*a*) to 4(*d*) are diagrams illustrating a manufacturing process for the inkjet head according to the first embodiment.
Figure 4B:
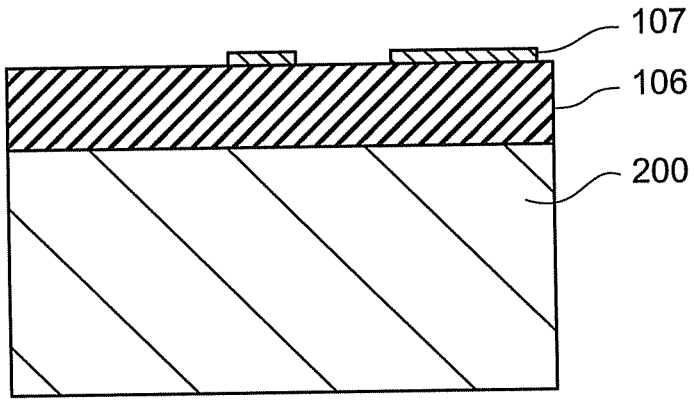
Figure 4C:
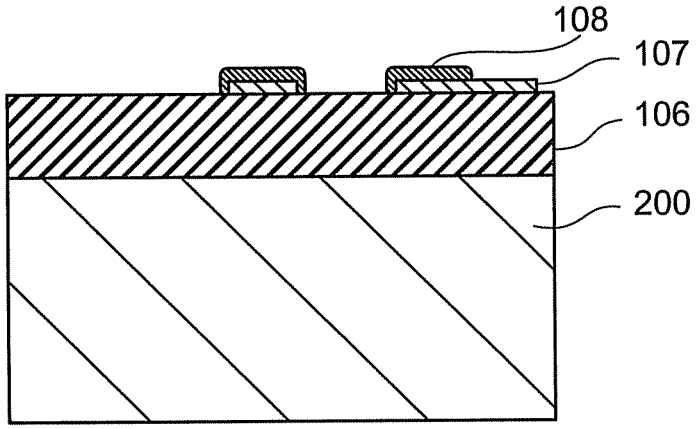
Figure 4D:
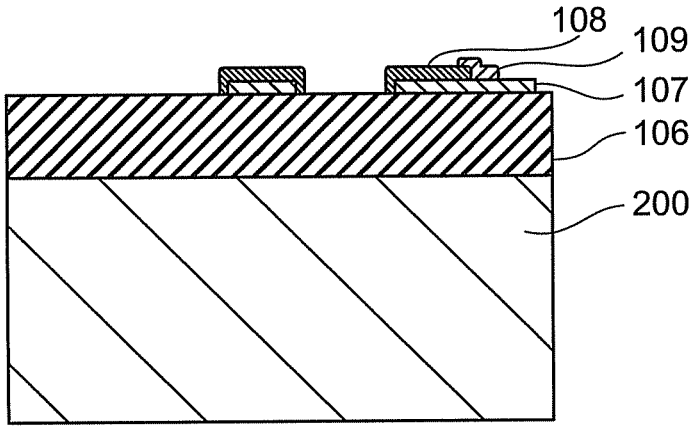
Figure 5E:
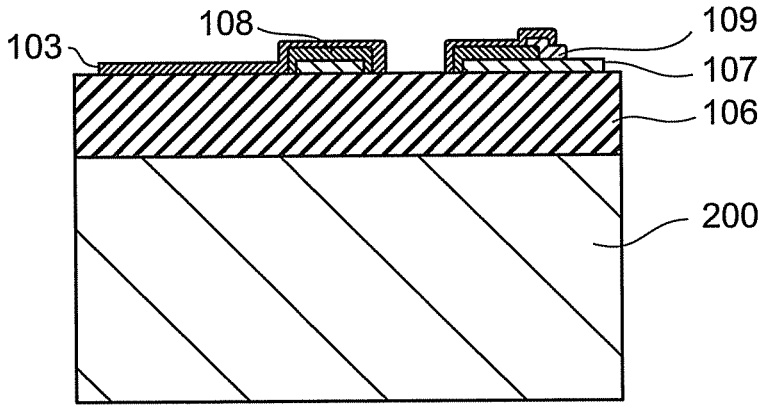
FIGS. 5(*e*) to 5(*h*) are diagrams illustrating a manufacturing process for the inkjet head following the manufacturing process shown in FIGS. 4(*a*) to 4(*d*)
Figure 5F:
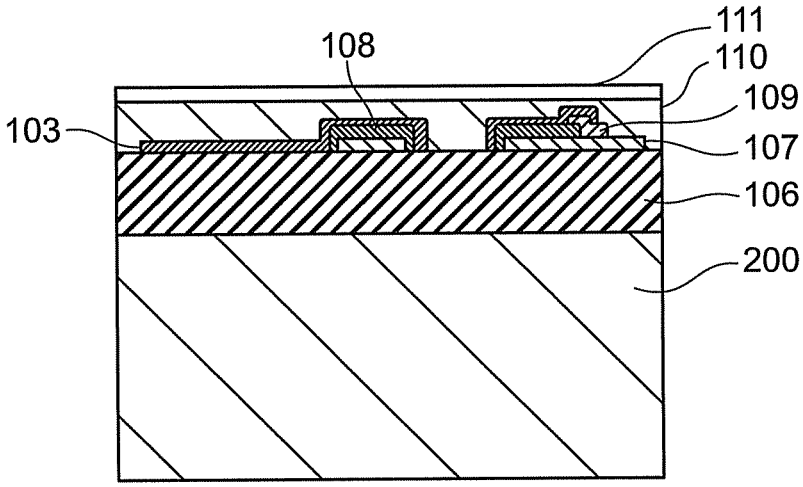
Figure 5G:
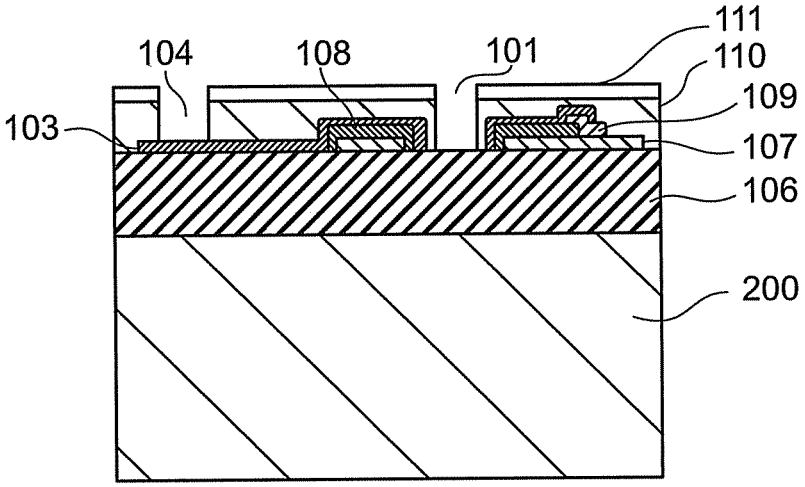
Figure 5H:
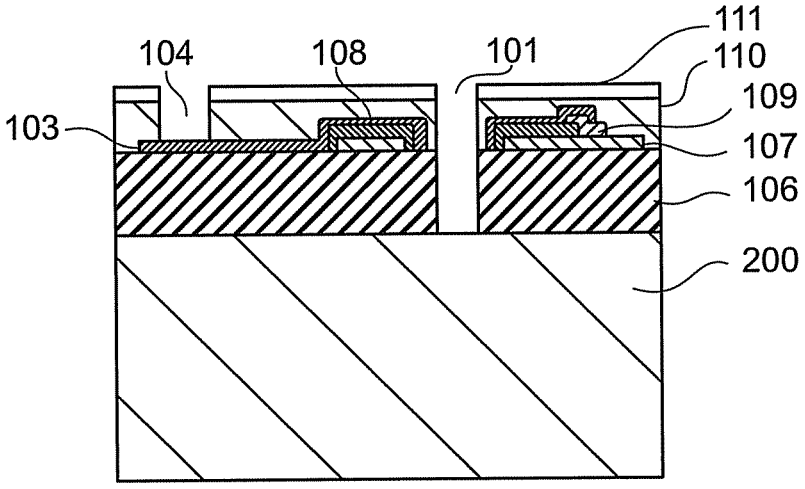

The constitution of the nozzle plate 100 is further explained with reference to FIG. 3. FIG. 3 is a plan view of the nozzle plate 100 viewed from the ink ejection side.

The nozzle plate 100 includes the nozzles 101 through which ink is ejected and, actuators 102 generating pressure for ejecting ink from the nozzles 101. The nozzle plate 100 includes wiring electrodes 103 and a common electrode 107 that transmit signals for driving the actuators 102. Further, the nozzle plate 100 includes wiring electrode terminal sections 104 that are a part of the wiring electrodes 103 to receive a signal for driving the inkjet head 1 from the outside of the inkjet head 1 and common electrode terminal sections 105 that are a part of the common electrode 107 to receive a signal for driving the inkjet head 1.

The actuators 102, the wiring electrodes 103, the wiring electrode terminal sections 104, the common electrode 107, and the common electrode terminal sections 105 are formed on an oscillating plate 106.

The nozzles 101 penetrate the nozzle plate 100. The center in the circular section of one of the ink pressure chambers 201 and the center of the nozzle 101 that corresponds with the one ink pressure chamber 201 coincide with each other. Ink is supplied from one of the ink pressure chambers 201 into a corresponding nozzle 101. The oscillating plate 106 is deformed by the operation of the actuator 102 corresponding to the nozzle 101. Ink supplied to the nozzle 101 is ejected by a pressure change caused in the ink pressure chamber 201. All the nozzles 101 perform the same operation.

Even if the centers in the circular section of one of the ink pressure chambers 201 and the nozzle 101 that corresponds with the one ink pressure chamber 201 are offset, ink can be ejected from the nozzle 101 by the pressure change generated in the ink pressure chamber 201. The inkjet head 1 having the ink pressure chamber 201 and the nozzle 101 centers of which are coincident with one another can uniform the direction of the ink ejection among nozzles compared to the inkjet head 1 having those the centers of which are offset.

The nozzles 101 can, for example, be formed in a cylindrical shape and have a diameter of 20 μm.

The actuators 102 can be formed of piezoelectric films, for example. Each of the actuators 102 operates using the piezoelectric film and two electrodes (the wiring electrode 103 and the common electrode 107) that interpose the piezoelectric film. The piezoelectric film and two electrodes are layered, i.e., piezoelectric layer, wiring electrode layer, and common electrode layer. When the piezoelectric film is formed, polarization occurs in the thickness direction of the piezoelectric film. If an electric field in a direction the same as that of the polarization is applied to the piezoelectric film via the electrodes, the actuator 102 extends and contracts in a direction orthogonal to the electric field direction. The oscillating plate 106 is deformed, using this extension and contraction and, causes a pressure change in the ink contained in the ink pressure chamber 201. The shape of the piezoelectric film is patterned in circle in accordance with the cross-section of the ink pressure chamber 201 and has a circular opening concentric with the nozzle 101. The diameter of the circular piezoelectric film can be set, for example, to 170 μm. In other words, the piezoelectric film is present in a circle concentric with the ejection side opening of the nozzle 101 such that it surrounds the ejection side opening of the nozzle 101.

The actuators 102 respectively having the nozzles 101 at the center thereof, include the piezoelectric films having a diameter of 170 μm. Therefore, the actuators 102 can be arranged in zigzag (staggered) pattern in order to arrange the nozzles 101 at higher density. The plural nozzles 101 are arranged linearly in an X axis direction of FIG. 3. Two linear nozzle rows are provided in a Y axis direction. The distance between the centers of the nozzles 101 adjacent to one another in the X axis direction can be set to 340 μm, for example. An arrangement interval of two rows of the nozzles 101 can be set to 240 μm in the Y axis direction, for instance. By arranging the nozzles 101 in this way, each of the wiring electrodes 103 can be formed to pass between two actuators 102 in the X axis direction.

The piezoelectric film can be made of PZT (lead zirconate titanate). Other materials that can also be used include PTO (PbTiO3: lead titanate), PMNT (Pb(Mg⅓Nb⅔)O3-PbTiO3: lead magnesium niobate-lead titanate), PZNT (Pb(Zn⅓Nb⅔)O3-PbTiO3), ZnO (zinc oxide), AlN (aluminum nitride), and the like.

The piezoelectric film can be formed at substrate temperature of 350 degrees Celsius by an RF magnetron sputtering method. The thickness of the piezoelectric film, for example, can be set to 1 μm. After the piezoelectric film is formed, in order to give piezoelectric properties to the piezoelectric film, heat treatment can, for example, be performed for three hours at 500 degrees Celsius. Consequently, satisfaction in piezoelectric performance can be obtained. Other manufacturing methods for forming the piezoelectric film can include a CVD (chemical vapor deposition method), a sol-gel method, an AD method (aero-sol deposition method), a hydrothermal synthesis method, and the like. The thickness of the piezoelectric film is determined according to a piezoelectric characteristic, a dielectric breakdown voltage, and the like. The thickness of the piezoelectric film is generally in a range from less than or equal to 0.1 μm to greater than or equal to 5 μm.

Each of the wiring electrodes 103 is one of the two electrodes that interpose the piezoelectric film of the plural actuators 102. The plural wiring electrodes 103 are formed on the ejection side with respect to the piezoelectric film. Each of the wiring electrodes 103 is separately connected to the piezoelectric film of the actuator 102 corresponding thereto. Each of the wiring electrodes 103 acts as an individual electrode for causing the piezoelectric film to independently operate. Each of the wiring electrodes 103 includes a circular electrode section having a diameter larger than that of the circular piezoelectric film (actuator electrode), a wiring section, and the wiring electrode terminal section 104. The nozzle 101 is formed in the center of the circular electrode section. Therefore, the section without the wiring electrode film is formed in a shape of a circle concentric with the nozzle 101.

The plural wiring electrodes 103 can be formed, for example, of a Pt (platinum) thin film. For the formation of the thin film, a sputtering method can be used. The thickness of the thin film can be set to 0.5 μm, for example. Other electrode materials that can be employed for the wiring electrodes 103 include Ni (nickel), Cu (copper), Al (aluminum), Ti (titanium), W (tantalum), Mo (molybdenum), Au (gold), and the like. Other film forming methods, such as, vapor deposition and metal plating can also be used. Desirable thicknesses of the plural wiring electrodes 103 range from less than or equal to 0.01 μm to greater than or equal to 1 μm, for example.

The common electrode 107 is one of the two electrodes connected to the piezoelectric film. The common electrode 107 can be formed on the ink pressure chamber 201 side with respect to the piezoelectric films. In other words, the common electrode 107 is disposed on an opposite side of the oscillating plate 106 facing the ink pressure chamber 201. The common electrode 107 can be connected in common to the piezoelectric films patterned corresponding to the each actuator 102 and acts as a common electrode. The common electrode 107 can include a circular electrode section having a diameter smaller than the circular piezoelectric film, a wiring section which is formed on the piezoelectric film in an opposite side to the individual electrode wiring sections and is gathered at both ends in the X axis direction of the nozzle plate 100, and the common electrode terminal sections 105. Since the nozzle 101 is formed in the center of the circular electrode section, like the wiring electrode film of the individual electrode, a section without a common electrode film is formed in a shape of a circle concentric with the nozzle 101.

The common electrode 107 can be formed of a Pt (platinum)/Ti (titanium) thin film, for example. For the formation of the thin film, a sputtering method can be used. The thickness of the thin film can be set to 0.5 μm, for example. Other electrode materials for the common electrode 107 can include Ni, Cu, Al, Ti, W, Mo, Au, and the like. Other film forming methods such as, vapor deposition and metal plating can also be used. Desirable thickness of the common electrode 107 can range from less than or equal to 0.01 μm to greater than or equal to 1 μm.

The wiring electrode terminal sections 104 and the common electrode terminal sections 105 are provided in order to receive a signal for driving the actuators 102 from an external driving circuit. Since the wiring electrodes 103 and the common electrode 107 are wired through a space among the adjacent actuators 102, in this embodiment, the wiring width is set about 80 μm.

The common electrode terminal sections 105 are provided on both end sides of the individual wiring terminal sections 104 viewed in the X axis direction. An interval of the wiring electrode terminal sections 104 is the same as an interval 170 μm in the X axis direction of the plural nozzles 101 due to staggered arrangement of the nozzles 101. Therefore, the width in the X axis direction of the wiring electrode terminal sections 104 can be set large compared with the wiring width of the wiring electrodes 103. This makes it easy to connect the external driving circuit and the wiring electrode terminal sections 104. The wiring electrodes 103 function as individual electrodes configured to drive the actuators 102. The external driving circuit can be made an integrated circuit which includes first wirings electrically connected with the common electrode 107 and plural second wirings electrically connected with the individual wiring electrode terminal section 104 to selectively apply a voltage to the individual electrode 103 according to an image signal. The voltage applied between the selected individual electrode 103 and the common electrode 107 causes the actuator 102 to change the volume of the ink pressure chamber 201 to eject ink from the nozzle 101.

A method of manufacturing this inkjet head is explained with reference to an A-A' section shown in FIG. 3.

FIGS. 4(*a*) to 7(*m*) are diagrams of a manufacturing process of the inkjet head. The inkjet head can be manufactured by way of depositing materials forming a thin film or spin-coating the materials.

FIG. 4(*a*) is a diagram of a construction in which the oscillating plate 106 is formed on the ink pressure chamber structure 200. In order to form the nozzle plate 100, a silicon wafer subjected to mirror polishing is used for the ink pressure chamber structure 200. In a process for fabricating the nozzle plate 100, since heating and formation of a thin film is repeated, a silicon wafer having heat resistance is used. The silicon wafer is a smoothed silicon wafer having thickness of 525 μm to 775 μm conforming to the SEMI (Semiconductor Equipment and Materials International) standard. Instead of a silicon wafer, a substrate of ceramics, quartz, or various kinds of metal having heat resistance can also be used.

In regard to the oscillating plate 106, a SiO2 film (silicon dioxide) formed by the CVD method can be used. The film having thickness of about 6 μm can be formed over the entire surface of the ink pressure chamber structure 200. In lieu of the CVD method, a thermal oxidation method in which heating a silicon wafer in oxygen environment makes a surface of the wafer change to a SiO2 film can be usable in order to form the oscillating plate 106.

The thickness of the oscillating plate 106 can desirably be in a range from less than or equal to 1 μm to greater than or equal to 50 μm. Instead of SiO2, SiN (silicon nitride), Al2O3 (aluminum oxide), HfO2 (hafnium dioxide), or DLC (Diamond Like Carbon) can also be used. Generally, the material used for the oscillating plate 106 is selected taking into account heat resistance, insulating properties, a coefficient of thermal expansion, smoothness, and wettability to ink. In terms of the insulating properties, if the inkjet head 1 includes the oscillating plate 106 having a low permittivity, i.e., low insulating property, to eject ink having high conductivity, the high conductive ink may be electrolyzed by a drive voltage applied to the actuator 102 because current flows via the high conductive ink. The electrolysis of the high conductive ink may cause decomposed ink to adhere to the actuator 102 resulting in the deterioration of the inkjet head 1. Therefore, taking into account that a high conductive ink, e.g., an aqueous ink, is ejected from the inkjet head 1, a higher resistivity material may be preferable to form the oscillating plate 106.

In FIG. 4(*b*), formation of the common electrode 107 formed on the oscillating plate 106 is shown. An electrode material can be Pt and Ti. Films of Ti and Pt can be formed by a sputtering method. The film thickness of Ti can be set to 0.45 μm, and the film thickness of Pt can be set to 0.05 μm, for example.

After the electrode film is formed, the electrode film can be patterned into a shape suitable for the actuator 102, the wiring section, and the common electrode terminal section 105 to form the common electrode 107. The patterning can be performed by forming an etching mask on the electrode film and removing electrode materials excluding a portion covered by the etching mask through an etching process. The etching mask is formed by, after applying a photoresist on the electrode film, performing a pre-bake, exposing the photoresist using a mask on which a desired pattern is formed, and performing a post-bake after a development process.

A portion of the common electrode 107 corresponding to a piezoelectric film 108 is smaller than the outer diameter of the piezoelectric film and is a circular pattern having an outer diameter of 166 μm. Since the nozzle 101 is formed in the center of the circular common electrode 107, a portion having a diameter of 34 μm without an electrode film is formed as a concentric circle from the center of the circular common electrode 107. Since the common electrode 107 is patterned, the oscillating plate 106 is exposed in sections excluding the circular section and the wiring section of the common electrode 107.

In FIG. 4(*c*), the piezoelectric film 108 formed on the common electrode 107 is shown. The piezoelectric film 108 is formed on the common electrode 107 and the oscillating plate 106. For example, PZT can be used for the piezoelectric film 108. The piezoelectric film 108 having thickness of 1 μm can be formed by the sputtering method at substrate temperature of 350 degrees Celsius, for instance. In order to give piezoelectric properties to the PZT thin film, heat treatment can be performed for three hours at 500 degrees Celsius. When the PZT thin film is formed, polarization occurs along a film thickness direction from the common electrode 107. Namely, the PZT thin film is polarized in a normal direction to the surface of the oscillating plate 106.

The patterning of the piezoelectric film 108 can be performed by forming an etching mask on the piezoelectric film and, removing piezoelectric materials excluding a portion covered by the etching mask with etching. The etching mask can be formed by, after applying a photoresist on the piezoelectric film, performing a pre-bake, exposing the photoresist using a mask on which a desired pattern is formed, and performing a post-bake after a development process.

A pattern of the piezoelectric film 108 is a circular shape having an outer diameter of 170 μm. Since the nozzle 101 is formed in the center of the circular pattern, a portion having a diameter of 30 μm without a piezoelectric film in a concentric circle is formed from the center of the circular piezoelectric film 108. The oscillating plate 106 is exposed in the portion having the diameter of 30 μm without the piezoelectric film. Since the diameter of the portion without the circular piezoelectric film is 30 μm and the diameter of the portion without the circular common electrode 107 is 34 μm, the piezoelectric film 108 is formed to cover the common electrode 107 included in the actuator 102. Since the piezoelectric film 108 covers the common electrode 107, insulating properties between the common electrode 107 and the other wiring electrode 103 for applying a voltage to the piezoelectric film 108 can be secured. In other words, the wiring electrode 103 functioning as an individual electrode for driving the actuator 102 and the common electrode 107 are insulated by the piezoelectric film 108.

In FIG. 4(*d*), an insulating film 109 on the piezoelectric film 108 and the common electrode 107 in a section corresponding to D in FIG. 3 is shown. In order to keep the insulation between the wiring section of the common electrode 107 and the actuator wiring electrode 103 of the individual electrode included in the actuator 102, the insulating film 109 is formed on the surfaces of the piezoelectric film 108 and the common electrode 107. The thickness of the insulating film 109 can be set to 0.2 μm and the material used for the insulating film 109 can be SiO2, for example. For the formation of the insulating film 109, a CVD method that can realize satisfactory insulating properties with low-temperature film formation can be used. Since the insulating film 109 has to be formed only on the surfaces of the piezoelectric film 108 and the common electrode 107, patterning can be performed. After a resist is applied, a pre-bake can be performed, exposure can be performed using a mask of a desired pattern, development can be performed, and a post-bake can be performed to fix an etching mask. Etching can be performed using this etching mask to obtain a desired insulating thin film. The insulating film 109 can be patterned to cover a part of the piezoelectric film 108 taking into account a variation in the patterned shape. An amount of covering of the piezoelectric film 108 by the insulating film 109 can be set to a degree for not hindering a deformation amount of the piezoelectric film 108.

In FIG. 5(*e*), the wiring electrode 103 (the individual wiring electrode) formed on the oscillating plate 106, the piezoelectric film 108, and the insulating film 109 are shown. The wiring electrode 103 can be made of Pt and can have a thickness of 0.5 μm. The wiring electrode 103 can be formed by a sputtering method. After the electrode material is formed on the patterned piezoelectric film 108, the insulating film 109, and the oscillating plate 106, an electrode film is patterned into a shape suitable for the actuator 102, the wiring section, and the wiring electrode terminal section 104 to form the individual wiring electrode 103. The patterning can be performed by forming an etching mask on the electrode film and removing electrode materials excluding a portion covered by the etching mask with etching. The etching mask can be formed by, after applying a photoresist on the electrode film, performing a pre-bake, exposing the photoresist using a mask on which a desired pattern is formed, and performing a post-bake after a development process.

A portion of the wiring electrode 103 corresponding to the piezoelectric film 108 is a circular pattern, i.e., an actuator electrode, having an outer diameter of about 174 μm. Since the nozzle 101 is formed in the center of the circular wiring electrode 103, a portion having a diameter of about 26 μm without an electrode film in a concentric circle is formed from the center of the circular wiring electrode 103. In other words, the circular wiring electrode 103 included in the actuator 102 is formed in a shape that totally covers the piezoelectric film 108.

Other film formation materials that can be used for the wiring electrode 103 include Cu, Al, Ag, Ti, W, Mo, Pt, and Au. Other formation methods that can be used for the wiring electrode 103 include vacuum deposition, metal plating, and the like. The thickness of the wiring electrode 103 can desirably be in the range of 0.01 μm to 1 μm.

In FIG. 5(*f*), a passivation film (passivation layer) 110 and a metal film 111 formed on the oscillating plate 106, the wiring electrode 103, the common electrode 107, and the insulating film 109 are shown. Namely the metal film 111, the passivation film 110, the wiring electrode 103, the piezoelectric film 108, the common electrode 107, and the insulating film 109 are layered, each of which has a desired pattern on the oscillating plate 106. The passivation film 110 can be made of polyimide and can have a thickness of 3 μm, for example. The passivation film 110 can be formed by, after forming a film of a solution containing a polyimide precursor with a spin coating method, performing thermal polymerization and solution removal with a bake. By forming the film with the spin coating method, a film having a smooth surface can be formed, which covers the actuator 102, the wiring electrode 103, and the common electrode 107 formed on the oscillating plate 106.

For the passivation film 110, instead of polyimide, resin materials such as ABS (acrylonitrile butadiene styrene), polyacetal, polyamide, polycarbonate, and polyether sulfone can also be used. Additionally or alternatively, a ceramic material, i.e., nitrides and oxides such as zirconia, silicon carbide, silicon nitride, and barium titanate can also be used. Further, a metal material (alloy) can also be used. Representative materials that can be used include materials such as aluminum, stainless, and titanium. As to formation methods, CVD, vacuum deposition, metal plating, and the like can be employed. The thickness of the passivation film 110 can desirably be in the range of about 1 μm to about 50 μm.

In selection of a material for the passivation film 110, it may be desirable to select the material, the Young's modulus of which is substantially different from that of the oscillating plate 106. Generally, a deformation amount of a plate is adversely affected by its Young's modulus and the thickness of the plate material. Even if the same force is applied, deformation is larger as the Young's modulus is smaller and the plate thickness is smaller. In this embodiment, the Young's modulus of a SiO2 film of the oscillating plate 106 can be 80.6 GPa and the Young's modulus of a polyimide film of the passivation film 110 can be 10.9 GPa. Accordingly, there is a difference in Young's modulus of 69.7 GPa between the oscillating plate 106 and the passivation film 110. A reason for the combination of the materials is explained below.

The inkjet head 1 according to this embodiment has a structure in which the actuator 102 is sandwiched in between the oscillating plate 106 and the passivation film 110. If an electric field is applied to the actuator 102 and the actuator 102 extends in a direction orthogonal to that of the electric field, a force for deforming the oscillating plate 106 to the ink pressure chamber 201 side in a concave shape is applied to the oscillating plate 106. Conversely, a force for deforming the passivation film 110 to the ink pressure chamber 201 side in a convex shape is applied to the passivation film 110. If the actuator 102 contracts in a direction orthogonal to that of the electric field, a force for deforming the oscillating plate 106 to the ink pressure chamber 201 side in a convex shape is applied to the oscillating plate 106 and a force for deforming the passivation film 110 to the ink pressure chamber 201 side in a concave shape is applied to the passivation film 110. In other words, if the actuator 102 extends and contracts in the direction orthogonal to that of the electric field, forces for deforming the oscillating plate 106 and the passivation film 110 in exactly opposite directions are applied to the oscillating plate 106 and the passivation film 110 respectively. Therefore, if the thicknesses and Young's modulus of the oscillating plate 106 and the passivation film 110 are the same, the forces for deforming the oscillating plate 106 and the passivation film 110 in exactly opposite directions by the same amount are applied thereto even if a voltage is applied to the actuator 102. The nozzle plate 100 is not deformed and therefore ink is not ejected.

In this embodiment, the Young's modulus of the polyimide film of the passivation film 110 can be smaller than the Young's modulus of the SiO2 film of the oscillating plate 106. Therefore, a deformation amount of passivation film 110 can be larger than that of the oscillating plate 106 with respect to the same force. In the structure of this embodiment, if the actuator 102 extends in a direction orthogonal to that of the electric field, the nozzle plate 100 is deformed to the ink pressure chamber 201 side in a convex shape and the volume of the pressure chamber 201 is reduced, because an amount of deformation of the passivation film 110 to the ink pressure chamber 201 side in a convex shape is larger. Conversely, if the actuator 102 contracts in a direction orthogonal to that of the electric field, the nozzle plate 100 is deformed to the ink pressure chamber 201 side in a concave shape and the volume of the pressure chamber 201 is increased, because an amount of deformation of the passivation film 110 to the ink pressure chamber 201 side in a concave shape is larger.

Since the difference in Young's modulus between the oscillating plate 106 and the passivation film 110 is larger, the difference in deformation amount between the oscillating plate 106 and the passivation film 110 increases when the same voltage is applied to the actuator 102. Therefore, ink ejection can be performed under a lower voltage if the difference in Young's modulus between the oscillating plate 106 and the passivation film 110 is larger.

As explained above, the deformation amount of the plate is affected by not only the Young's modulus of the plate material but also the thickness of the plate material. Therefore, if a deformation amount of the oscillating plate 106 and a deformation amount of the passivation film 110 are set differently, it can be necessary to take into account both Young's modulus and thickness of the respective materials. Even if the Young's moduli of the oscillating plate 106 and the passivation film 110 are the same, if the thicknesses are different, ink ejection is possible, although a high voltage is needed to drive the actuator 102.

Besides, in selection of a material of the passivation film 110, the selection is performed taking into account heat resistance, insulating properties, a coefficient of thermal expansion, smoothness, and wettability to ink. In terms of the insulating properties, it may be desirable to select the material of the passivation film 110 having a higher resistivity to prevent ink from deteriorating due to electrolysis in case that the ink having high electric conductivity is supplied to the inkjet head 1.

The metal film 111 can be an aluminum film and can be formed on the polyimide film at thickness of 0.4 μm by a sputtering method. The metal film 111 can be used as a mask in dry-etching the passivation film 110 and the oscillating plate 106 explained later.

For the metal film 111, instead of aluminum, Cu, Ag, Ti, W, Mo, Pt, and Au can be used. Other formation methods for the metal film 111 that can be used include CVD, vacuum deposition, metal plating, or the like. The thickness of the metal film 111 is desirably in a range of 0.01 μm to 1 μm.

In FIG. 5(*g*), the metal film 111 and the passivation film 110 patterned into a shape suitable for the nozzle 101, the wiring electrode terminal section 104, and the common electrode terminal section 105 shown in FIG. 3 are shown. A method for this patterning is explained.

First, the metal film 111 is etched into a circular pattern having a diameter of about 20 μm for the nozzle 101 and square patterns for the wiring electrode terminal section 104 and the common electrode terminal section 105 shown in FIG. 3 using a photoresist and the etching method.

Subsequently, dry etching for the passivation film 110 is performed using the patterned metal film 111 as a mask to form the circular pattern of the nozzle 101 and the square patterns of the wiring electrode terminal section 104 and the common electrode terminal section 105 shown in FIG. 3.

In FIG. 5(*h*), the oscillating plate 106 patterned into a shape suitable for the nozzle 101 is shown. The patterning for the oscillating plate 106 is performed by dry etching using the metal film 111, the wiring electrode terminal section 104, and the common electrode terminal section 105 as a mask. Since the wiring electrode terminal section 104 and the common electrode terminal section 105 have an etching-gas, resistance like the metal film 111, the oscillating plate 106 under the wiring electrode terminal section 104 and the common electrode terminal section 105 is not etched. A circular hole in the oscillating plate 106 is drilled concentric with the nozzle 101.

Figure 6I:
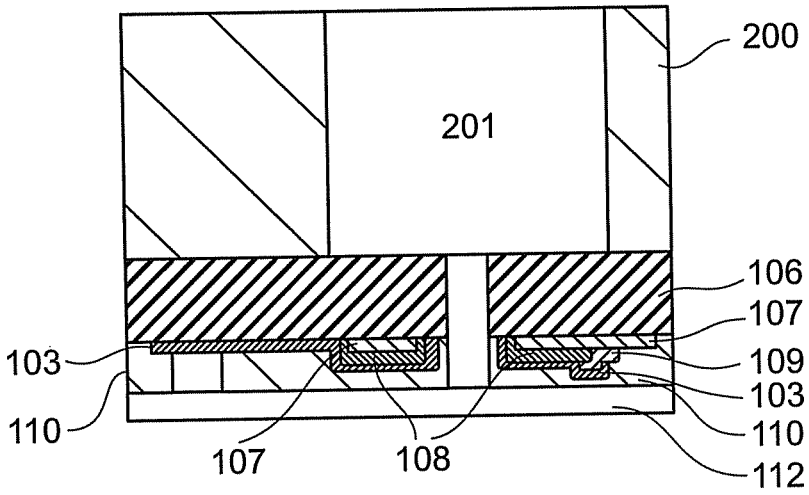
FIGS. 6(*i*) to 6(*k*) are diagrams illustrating a manufacturing process for the inkjet head following the manufacturing process shown in FIGS. 5(*e*) to 5(*h*)
Figure 6J:
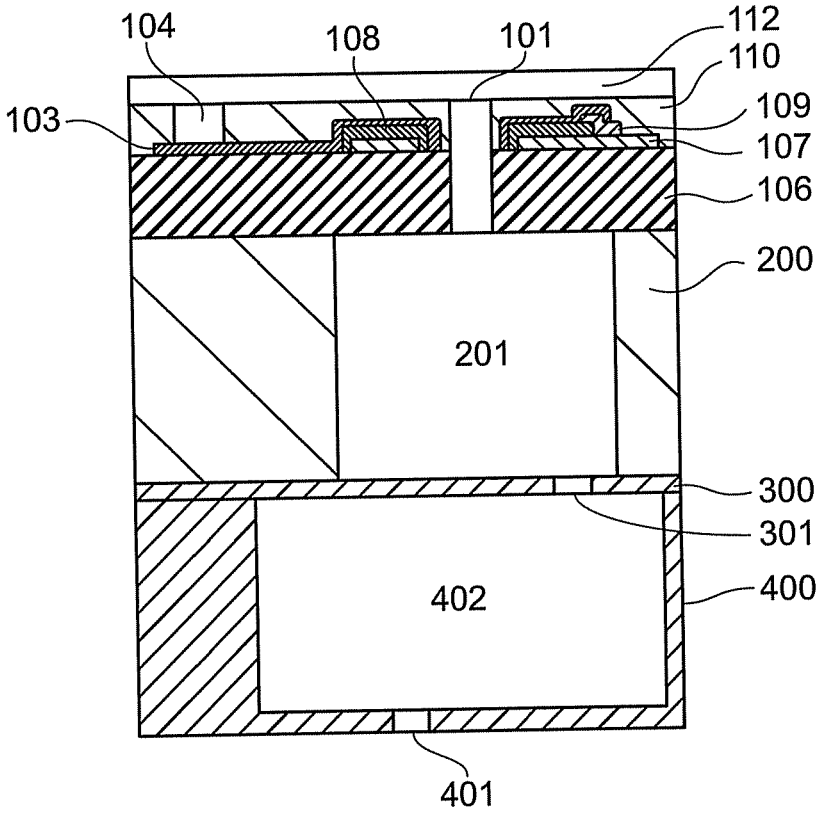
Figure 6K:
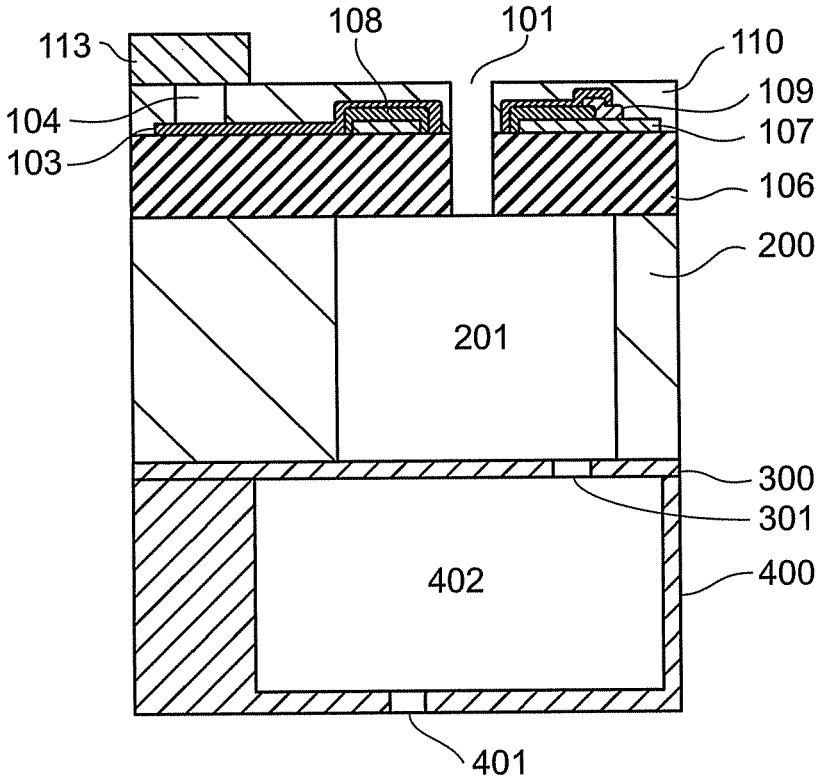

In FIG. 6(*i*), the inkjet head 1 having the passivation film 110 on which a protecting tape 112 is adhered is illustrated. The illustrated inkjet head 1 is vertically reversed to easily understand the structure of the ink pressure chamber 201 formed in the ink pressure chamber structure 200. The ink pressure chamber 201 is formed in a columnar shape having a diameter of about 240 μm. The ink pressure chamber 201 is patterned such that the center position of the ink pressure chamber 201 and the center position of the nozzle 101 substantially coincide with one another.

A patterning method for an ink pressure chamber is explained. After the metal film 111 shown in FIG. 5(*h*) is removed by etching, the protecting tape 112 is adhered on the passivation film 110. As the protecting tape 112, a back protection tape for chemical mechanical polishing (CMP) for a silicon wafer can be used, for example.

An etching mask is formed on the ink pressure chamber structure 200, which can be a silicon wafer having a thickness of 725 μm. The silicon wafer excluding the etching mask can be removed to form the ink pressure chamber 201 using a vertical deep drilling dry etching technique called Deep-RIE exclusive for a silicon substrate. The etching technique is, for example, disclosed in WO2003/030239 filed by Sumitomo Precision Products Co., Ltd. The etching mask is formed by, after applying a photoresist on the ink pressure chamber structure 200, performing a pre-bake, exposing the photoresist using a mask on which a desired pattern is formed, developing the photoresist, and performing a post-bake.

For the Deep-RIE exclusive for a silicon substrate, SF6 (sulfur hexafluoride) is used as an etching gas. However, the SF6 gas does not have an etching action on the SiO2 film of the oscillating plate 106 and the polyimide film of the passivation film 110. Therefore, the progress of the dry etching of the silicon wafer forming the ink pressure chamber 201 is stopped by the oscillating plate 106. In other words, the SiO2 film 106 serves as a stop layer for the Deep-RIE etching.

Forming the ink pressure chamber 201 in the ink pressure chamber structure 200 can result in the fluid-communication between the ink pressure chamber 201 and the nozzle 101. The nozzle 101 is formed in the oscillating plate 106 and the passivation layer 110. Namely the passivation layer 110 is formed such that it locates on the winding electrode 103 at a side opposite to the ink pressure chamber 201 with respect to the winding electrode 103, surrounding the nozzle 101. In this structure, the voltage is applied between the wiring electrode 103 and the common electrode 107 to activate the actuator 102, and thus the ink in the pressure chamber 201 can be ejected from the nozzle 101.

In the above explanation, a wet etching method in which a chemical is used or a dry etching method in which plasma is used is appropriately selected as an etching method. Fabrication is performed with the etching method and etching conditions that are respectively changed according to materials of the insulating film, the electrode film, the piezoelectric film, and the like. After the etching by the photoresist films ends, the photoresist films remaining on the ink pressure chamber structure 200 are removed by a solution.

In FIG. 6(*j*), a cross-section of the inkjet head 1 is shown, in which the separate plate 300 and the ink supply path structure 400 are bonded to the ink pressure chamber structure 200. The separate plate 300 and the ink supply path structure 400 are bonded by an epoxy resin. After the separate plate 300 and the ink supply path structure 400 are bonded, the separate plate 300 is bonded to the ink pressure chamber structure 200 by an epoxy resin.

In a cross-section shown in FIG. 6(*k*), an electrode terminal section cover tape 113 is stuck to the wiring electrode terminal section 104 and the common electrode terminal section 105 of the passivation film 110. After bonding strength of the protecting tape 112 illustrated in FIG. 6(*j*) is reduced to peel the protecting tape 112 by performing ultraviolet ray irradiation from the protecting tape 112 side, an electrode terminal section cover tape 113 is placed on a region of the wiring electrode terminal section 104 and the common electrode terminal section 105 shown in FIG. 3. This cover tape can be made of resin. The bonding strength of the cover tape can be equivalent to the bonding strength of adhesive tape that can be easily stuck and peeled. The electrode terminal section cover tape 113 is stuck for the purpose of preventing adhesion of dust to the wiring electrode terminal section 104 and the common electrode terminal section 105 and adhesion of a material of an ink-repellent film 114 to both of the terminal sections 104 and 105 while the ink-repellent film 114 is formed. The ink-repellent film 114 serves to prevent the ink from staying on the passivation film 110 and/or to return the ink on the passivation film 110 into the nozzle 101.

Figure 7I:
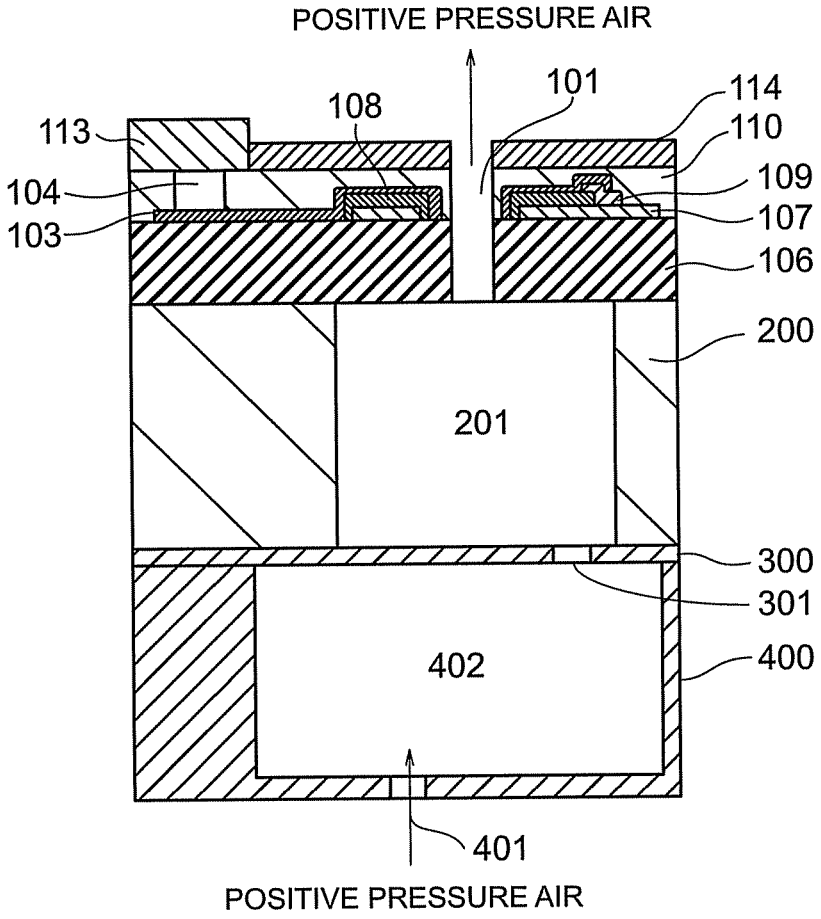
FIGS. 7(*l*) and 7(*m*) are diagrams illustrating a manufacturing process for the inkjet head following the manufacturing process shown in FIGS. 6(*i*) to 6(*k*)
Figure 7M:
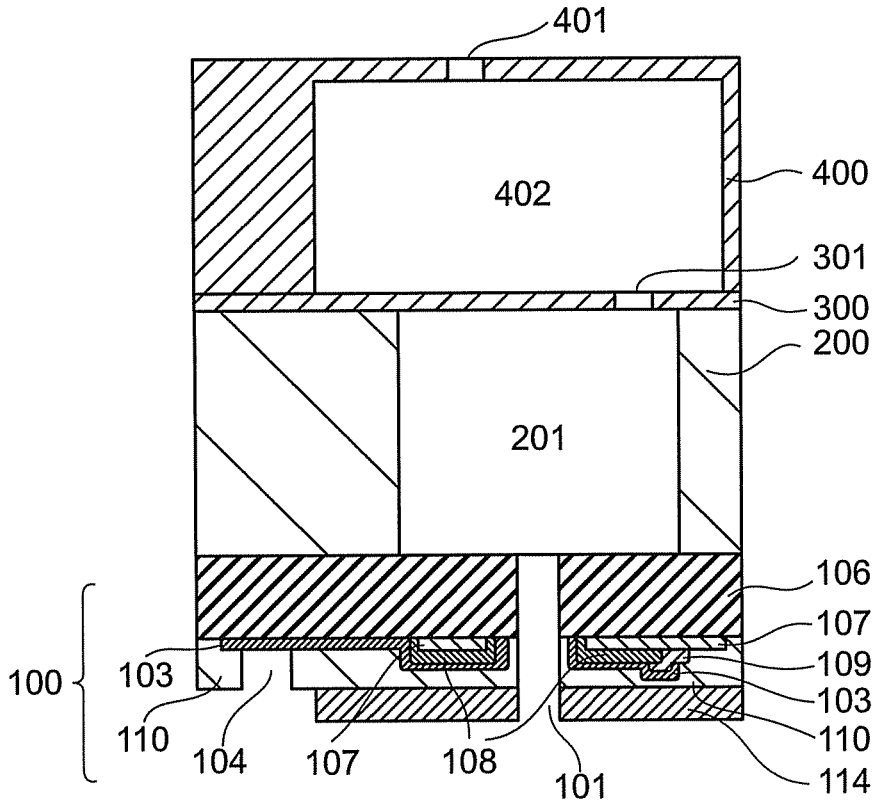

In a cross-section shown in FIG. 7(*l*), the ink-repellent film 114 is formed on the passivation film 110 excluding the inner wall of the nozzle 101. A material used for the ink-repellent film 114 can be a silicone repellent fluid material or a fluorine-containing organic material having fluid repellency. In the present embodiment, CYTOP, which is a commercially-available fluorine-containing organic material, manufactured by Asahi Glass Co., Ltd. can be used. The thickness of the ink-repellent film 114 is about 1 μm.

The ink-repellent film 114 can be formed by spin-coating to coat the passivation film 110 with an ink-repellent material in a fluid state. Positive-pressure air is injected from the ink supply port 401 to the ink pressure chamber 201 through the ink supply path 402, while the inkjet head 1 illustrated in FIG. 7(*k*) is fixed to a spin coater and spun for coating passivation film 110 with the ink-repellent material. Consequently, the positive pressure air is discharged from the nozzle 101 connected to the ink pressure chamber 201. If the ink-repellent film material in a fluid state is applied to the passivation film 110 in this state, the ink-repellent film material does not adhere to an ink channel on the inner wall of the nozzle 101 due to the flow of the positive pressure air and the ink-repellent film 114 is formed only on the passivation film 110.

A cross-section of the inkjet head 1 manufactured as described above is shown in FIG. 7(*m*). Ink is supplied from the ink supply port 401 provided in the ink supply path structure 400 to the ink supply path 402. The ink in the ink supply path 402 flows to the ink pressure chambers 201 via the ink supply chokes 301 and is filled in the nozzles 101. The ink supplied from the ink supply port 401 is kept at appropriate negative pressure. The ink in the nozzles 101 is kept without leaking from the nozzles 101.

In this embodiment described above, the nozzle plate 100 is composed of the oscillating plate 106, the common electrode 107, the wiring electrode 103, the piezoelectric film 108, and the passivation film 110, all of which are formed on the ink pressure chamber structure 200. Instead of the method in which the nozzle plate 100 is affixed to the ink pressure chamber structure 200, one of the surfaces of the ink pressure chamber structure 200 can be available for another oscillating plate 106 by processing the pressure chamber structure 200. After the electrode layer, piezoelectric film, insulating layer, and so on are layered on the one surface of the pressure chamber structure 200, the ink pressure chamber structure 200 is drilled from the other surface thereof such that a bore which does not penetrate the structure 200 is formed at a position on the other surface, facing the ink pressure chamber, which corresponds to the nozzle 101. A thin layer which remains on the one surface of the ink pressure chamber structure 200 after the drilling process is performed on the ink pressure chamber structure 200 functions as the other oscillating plate 106. In the structure, a portion of the ink pressure chamber structure 200 forms the nozzle plate 100, differing from the nozzle plate separated from the ink pressure chamber structure 200.

Figure 8:
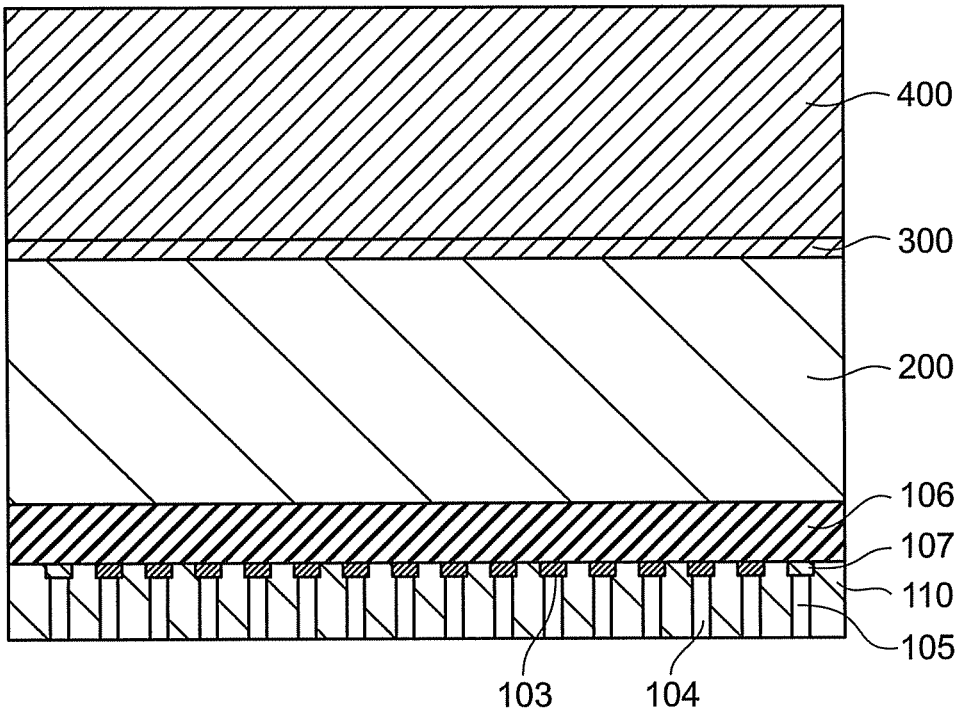
FIG. 8 is a sectional view of the inkjet head taken on line B-B' in FIG. 3.

FIG. 8 is a cross-section of the wiring electrode terminal section 104 and the common electrode terminal section 105 corresponding to the line B-B' shown in FIG. 3. The passivation film 110 is etched only to the wiring electrode terminal section 104 and the common electrode terminal section 105. The ink-repellent film 114 is not formed on the wiring electrode terminal section 104 and the common electrode terminal section 105.

Figure 9:
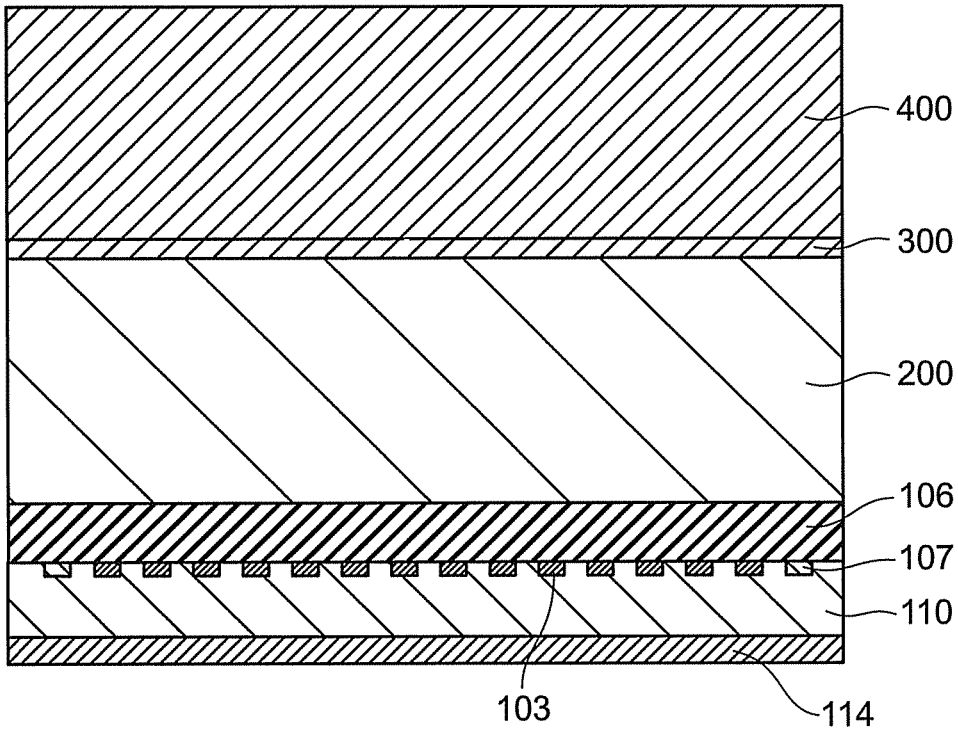
FIG. 9 is a sectional view of the inkjet head taken on line C-C' in FIG. 3.
Figure 10A:
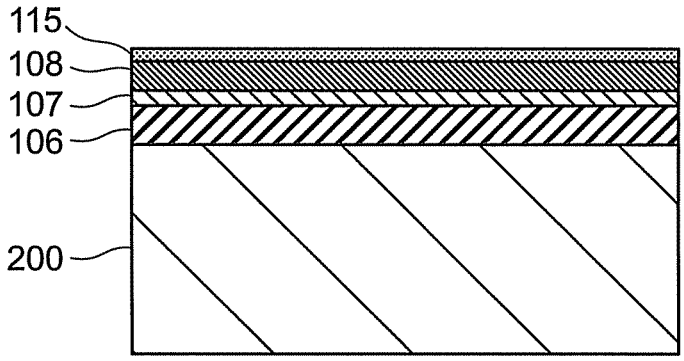
FIGS. 10(*a*) to 10(*d*) are diagrams illustrating a manufacturing process for the inkjet head according to a second embodiment.
Figure 10B:
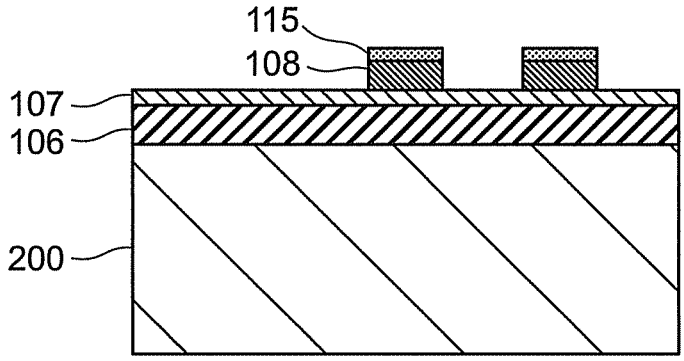
Figure 10C:
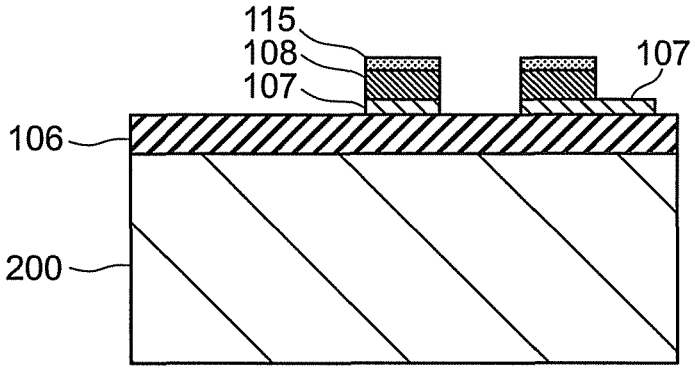
Figure 10D:
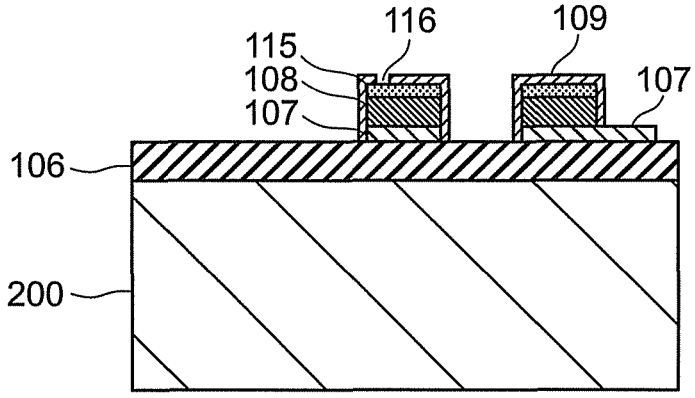

FIG. 9 is a cross-section of the wiring electrode 103 and the common electrode 107 corresponding to line C-C' shown in FIG. 3. Unlike the structure shown in FIG. 8, the passivation film 110 is formed on the wiring electrodes 103 and the common electrode 107 and the ink-repellent film 114 is formed on the passivation film 110.

Second Embodiment

Referring to FIGS. 10(*a*) through 11(*f*), a manufacturing process for an inkjet head 1 according to the second embodiment is explained. Figures in the drawings are a cross-section of the respective steps for manufacturing the inkjet head 1 explained in this embodiment. Steps following the step shown in FIG. 11(*f*) in the manufacturing process are the same as those explained with reference to FIGS. 6(*i*) to 7(*m*) in the first embodiment. In FIG. 12, a cross-section of the inkjet head 1 according to the second embodiment is illustrated.

The manufacturing process for the inkjet head 1 according to the second embodiment is now described. FIG. 10(*a*) is a cross-section of the inkjet head in a first step of the manufacturing process in which a plurality of layers forming an oscillating plate 106, a common electrode 107, a piezoelectric film 108, and an actuator electrode 115 are laminated in order on an ink pressure chamber structure 200. The respective materials of the ink pressure chamber structure 200, the oscillating plate 106, the common electrode 107, and the piezoelectric film 108 are the same as those of the first embodiment. Film forming method of the each layer is also the same as that to form each layer in the first embodiment. The thickness of the each layer is set to the same as that in the first embodiment. The layer of actuator electrode 115 is made of a platinum (Pt) having a thickness of 0.5 μm. The actuator electrode layer 115 is formed by sputtering method.

Other materials for the actuator electrode 115 can include Cu, Al, Ag, Ti, W, Mo, Pt, Au, and the like. Other film forming methods such as, vapor deposition and metal plating can also be used. Desirable thickness of the actuator electrode 115 can range from less than or equal to 0.01 μm to greater than or equal to 1 μm.

FIG. 10(*b*) is a cross-section of the inkjet head in a second step in which the two layers of the actuator electrode 115 and the piezoelectric film 108 are patterned in a circle to form a circular actuator 102. The diameter of the circle can be set 170 μm. In order to form the nozzle 101 concentric with the circular pattern, the two layers are etched to eliminate the two layers such that a circular bore having a diameter of 30 μm is concentrically formed in the circular pattern of the actuator 102. The layer of the common electrode 107 is exposed in the circular region of the bore of 30 μm which is formed by eliminating the two layers. The actuator electrode 115 functions as the wiring electrode 103 arranged to the actuator 102 illustrated in FIG. 3. A wiring electrode and a wiring electrode terminal section electrically connected with the circular pattern of the actuator electrode 115 are described later.

The patterning of the circular shapes having diameters of 30 μm and 170 μm can be performed by forming an etching mask on the actuator electrode layer and removing the two layers excluding a portion covered by the etching mask with an etching process. The etching mask is formed by, after applying a photoresist on the actuator electrode layer 115, performing a pre-bake, exposing the photoresist using a mask on which a desired pattern is formed, and performing a post-bake after a development process.

FIG. 10(*c*) is a cross-section of the inkjet head in a third step in which the layer of the common electrode 107 is patterned to form the actuator 102. The common electrode 107 includes a circular common electrode arranged under the circular piezoelectric film 108, and a wiring electrode and a common electrode terminal section 105 electrically connected with the circular common electrode. The circular common electrode having a diameter of 170 μm is concentrically and equally formed on the circular piezoelectric film 108. In order to form the nozzle 101 concentric with the circular common electrode 107, the layer of the common electrode 107 is etched to eliminate the part of common electrode layer such that a circular bore having a diameter of 30 μm is concentrically formed in the circular pattern of the circular piezoelectric film 108. The oscillating plate 106 is exposed in the bore.

The patterning of the circular common electrode, the wiring electrode, and the common electrode terminal section can be performed by forming an etching mask on the actuator electrode 115 and the common electrode layer 107 and removing the common electrode layers excluding a portion covered by the etching mask with an etching process. The etching mask is formed by, after applying a photoresist on the actuator electrode 115 and the common electrode layer 107, performing a pre-bake, exposing the photoresist using a mask on which a desired pattern is formed, and performing a post-bake after a development process.

FIG. 10(*d*) is a cross-section of the inkjet head in a fourth step in which an insulating layer 109 patterned in a circle is disposed to cover the circular actuator electrode 115 and the circular piezoelectric film 108. The insulating layer 109 is deposited on the circular actuator electrode 115, and is patterned to form a circular shape having a diameter of 174 μm. Since the insulating layer 109 of 174 μm diameter and the actuator electrode 115 of 170 μm diameter are concentrically arranged with each other, the insulating layer 109 covers the actuator electrode 115 and the piezoelectric film 108 over the circular surface of the actuator electrode 115 and thus the edge of the insulating layer 109 is brought into contact with the oscillating plate 106. In order to form the nozzle 101 concentric with the circular insulating layer 109, the insulating layer 109 has a bore having a diameter of 26 μm at which the insulating layer having the same diameter (26 μm) is not formed in the center of the circular insulating layer 109. The oscillating plate 106 is exposed to the bore of the circular insulating layer 109. The thickness of the insulating layer can be set to 0.2 μm. The material of the insulating layer 109 is a SiO2. The insulating layer is deposited by a CVD which realizes a sufficient permittivity of the insulating layer 109 at a low temperature. The construction in which the insulating layer 109 is brought into contact with the oscillating plate 106 can possibly protect the piezoelectric film 108 and prevent deterioration of the piezoelectric film 108, because the piezoelectric film 108 does not contact the ink passing through the nozzle 101.

Besides the insulating layer 109 provided on the actuator electrode 115 has a circular pit 116 having a diameter of 10 μm and the insulating layer 109 on the circular pit 116 is eliminated to electrically connect the actuator electrode 115 with a wiring electrode 117 described later through the circular pit 116. The insulating layer 109 is also formed between the wiring electrode 117 and the common electrode 107 so that an individual electrode including the actuator electrode 115, the wiring electrode 117, and the individual electrode terminal section 104 can be kept in an insulating state against the common electrode 107.

Figure 11E:
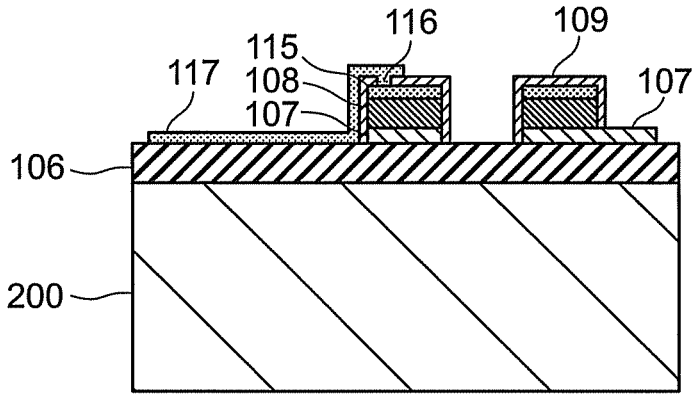
FIGS. 11(*e*) to 11(*f*) are diagrams illustrating a manufacturing process for the inkjet head following the manufacturing process shown in FIGS. 10(*a*) to 10(*d*)
Figure 11F:
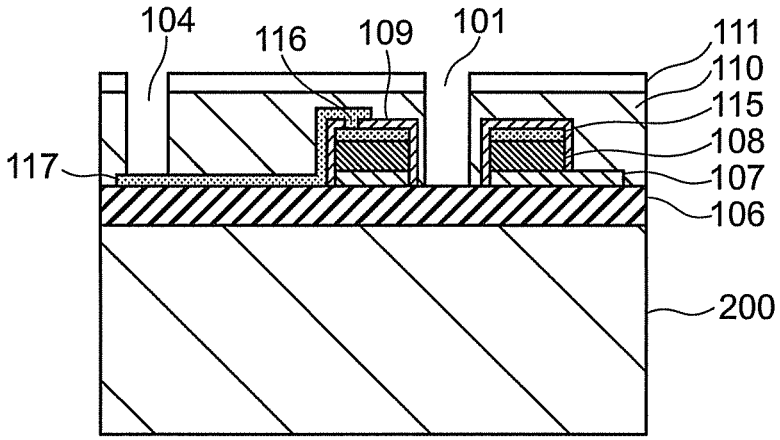
Figure 12:
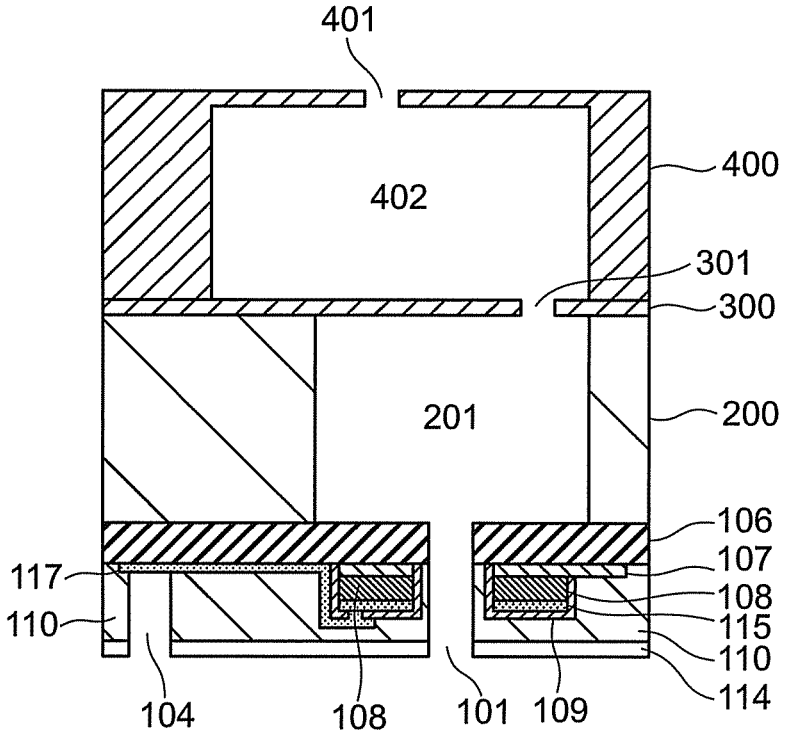
FIG. 12 is a sectional view of the inkjet head according to the second embodiment.

FIG. 11(*e*) is a cross-section of the inkjet head in a fifth step in which the wiring electrode 117 is formed on the pattern illustrated in FIG. 10(*d*). After the layer of the wiring electrode 117 is formed on the insulating layer 109, the oscillating plate 106, and the common electrode 107, the layer is patterned in a shape similar to the wiring electrode 103 and the wiring electrode terminal section 104 illustrated in FIG. 3 to form the wiring electrode 117. The wiring electrode 117 is brought into electrical contact with the actuator electrode 115 through the pit 116. A drive voltage generated by an external drive circuit is applied to the actuator electrode 115 through the wiring electrode terminal section 104 and the wiring electrode 103 so that the actuator 102 is activated to increase or decrease the volume of the ink pressure chamber 201 and eject the ink in the ink pressure chamber 201 through the nozzle 101.

The wiring electrode 117 is made of an aluminum (Al) having the thickness of 0.5 μm. The wiring electrode layer is formed by sputtering method. Other materials for the wiring electrode 117 can include Cu, Ag, Ti, W, Mo, Pt, Au, and the like. Other film forming methods such as, vapor deposition and metal plating can also be used. Desirable thickness of the wiring electrode 117 can range from less than or equal to 0.01 μm to greater than or equal to 1 μm.

FIG. 11(*f*) is a cross-section of the inkjet head in a sixth step in which two layers including a passivation layer 110 and a metal layer 111 are formed on the pattern illustrated in FIG. 11(*e*). A polyimide layer forming the passivation layer 110 and an aluminum layer forming the metal layer 111 are layered on the oscillating plate 106, the wiring electrode 117, the common electrode 107, and the insulating layer 109. Then the two layers are patterned to make the nozzle 101, the wiring electrode terminal section 104, and the common electrode terminal section 105 corresponding to the nozzle and the respective electrode terminal sections described in the first embodiment. The thicknesses of the passivation layer 110 and the metal layer 111 can be set the same as those of the first embodiment. The manufacturing method and patterning method of the respective layers are also the same as those of manufacturing the inkjet head 1 described in the first embodiment. The nozzle 101 has a bore having a diameter of 20 μm. The passivation layer 110 covers the actuator 102, the wiring electrode 117, and the wiring portion of the common electrode 107. In addition, the passivation layer 110 also covers a side surface of the insulating layer 109 which faces an inside of the nozzle surrounded by the insulating layer 109 and, contacts the oscillating plate 106, because the diameter of the bore, provided in the two layers, which forms the nozzle 101 is set smaller than that of the bore provided inside the insulating layer 109. Therefore the passivation layer 110 can prevent the insulating layer 109 from contacting ink.

FIG. 12 is a cross-section of the inkjet head 1 of the second embodiment. The manufacturing processes of the inkjet head 1 described referring to FIGS. 10(*a*) to 11(*f*) are similar to those described referring to FIGS. 6(*i*) to 7(*l*) in the first embodiment. The inkjet head 1 illustrated in FIG. 12 includes the nozzle plate formed by the aforementioned manufacturing process in the second embodiment, a separate plate 300, an ink pressure chamber structure 200, and an ink supply path structure 400. Drilling processes for forming a nozzle 101 in the oscillating plate 106 and for forming an ink pressure chamber 201 into the ink pressure chamber structure 200 are the similar to the processes described respectively in the first embodiment. An ink-repellent film is also formed on the passivation layer 110

Ink is supplied to the ink supply path 402 through an ink supply port 401 provided to the ink supply path structure 400. The ink supplied to the ink supply path 402 flows into each ink pressure chamber 201 through the ink choke 301 so that each nozzle 101 is filled with the ink. A drive waveform generated by an external drive circuit is applied to the actuator 102 integrated in the nozzle plate 100 to increase or decrease the volume of the ink pressure chamber 201. Consequently, the ink in the ink pressure chamber 201 is ejected from the nozzle 101.

An atomic arrangement in which atoms of the PZT thin layer i.e., piezoelectric layer 108, composed of titanium, zirconium, lead, oxygen, and so on, are positioned is confined by an atomic arrangement of Pt layer, i.e., the common electrode 107, which severs as a substrate for forming the PZT thin layer. In other words, the atomic arrangement of the PZT thin layer depends on the atomic arrangement of the Pt substrate. The confinement of the atomic arrangement causes the PZT layer to be polarized in a direction of the thickness thereof.

In case of the manufacturing process of the inkjet head shown in FIG. 4 according to the first embodiment, after the circular pattern of the common electrode 107 is formed on the oscillating plate 106, the PZT layer 108 is formed on the common electrode 107 to make a circular pattern, diameter of which is a little larger than the diameter of the common electrode 107. An atomic arrangement generated in a circular perimeter portion of the circular PZT layer 108 may be affected by an atomic arrangement of the common electrode 107 at a step portion formed of an edge of the circular common layer and the oscillating plate 106. Therefore, there may be a possibility that the PZT atomic arrangement in the thickness direction of the PZT layer is different between the circular perimeter portion of the PZT layer and an area of the PZT layer excluding the perimeter portion thereof. As a result, a polarizability of the PZT layer 108 at the perimeter portion thereof may become lower than the area of the PZT layer excluding the perimeter portion.

In the second embodiment, since the circular patterns of the common electrode 107 and the PZT layer 108 concentrically layered on the common electrode are made identical, the atomic arrangement of the PZT layer is uniform over the whole area of the PZT layer. Note that the common electrode 107 and the PZT layer are formed in the same circular shape except for a junction between the circular common electrode 108 and a wiring electrode electrically connected with the common electrode. The uniformity of the atomic arrangement realizes a higher polarizability of the PZT layer in the second embodiment compared to one in the first embodiment. The inkjet head 1 having the higher polarizability in the second embodiment can be activated by a lower voltage to eject ink from the nozzle 101, compared to one in the first embodiment.

Third Embodiment

Figure 13:
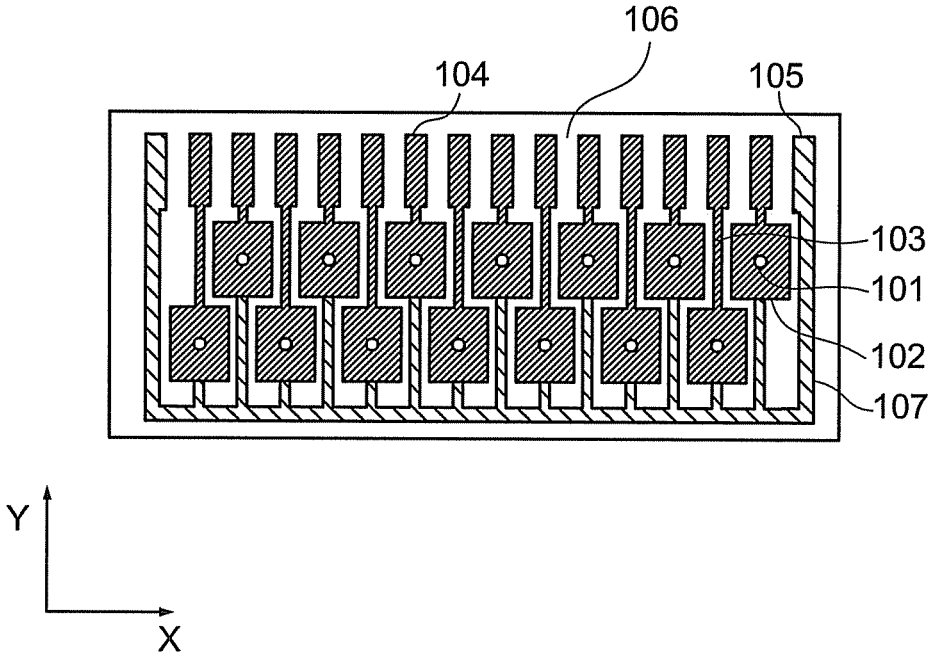
FIG. 13 is a plan view of an inkjet head according to a third embodiment.

The inkjet head 1 according to a third embodiment is shown in FIG. 13. The shape of the actuator 102 in the third embodiment is different from that in the first and second embodiments. However, other components of the inkjet head in the third embodiment are the same as those in the first and second embodiments.

The actuator 102 in this embodiment is formed in a rectangular shape having a width of about 170 μm and length of about 340 μm. The diameter of the nozzle 101 can be set to about 20 μm. The cross-section of the ink pressure chamber 201 is also a rectangular shape according to the shape of the actuator 102.

Compared with the circular piezoelectric film pattern, since the actuator 102 can be as large as 340 μm in the length direction, an actuator ejecting ink can be long. Therefore, it is possible to increase the ink ejection pressure.

Fourth Embodiment

Figure 14:
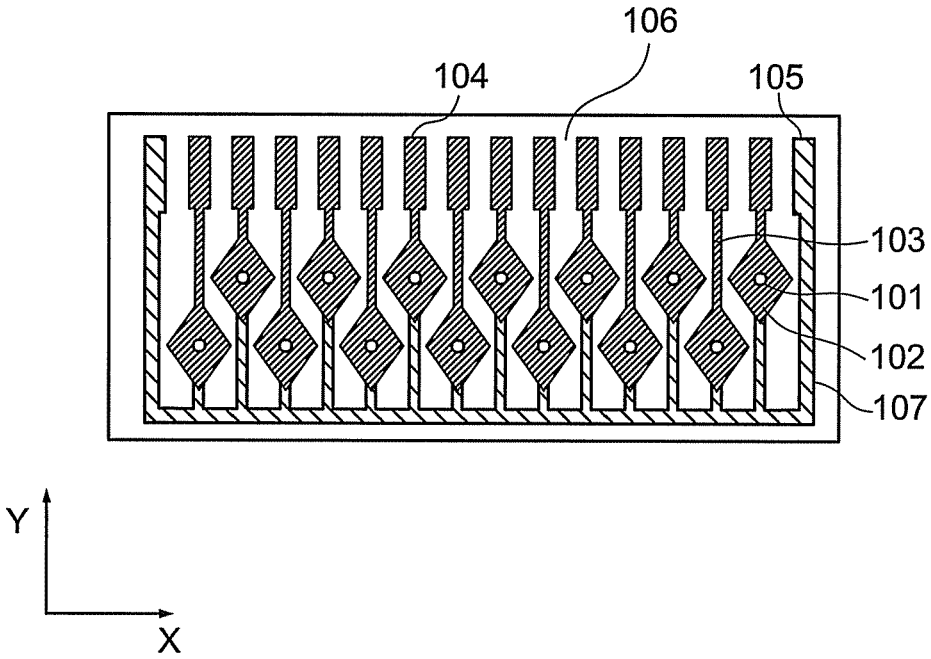
FIG. 14 is a plan view of an inkjet head according to a fourth embodiment.

The inkjet head 1 according to a fourth embodiment is shown in FIG. 14. The shape of the actuator 102 in the fourth embodiment is different from that in the first and second embodiments. However, other components of the inkjet head in the fourth embodiment are the same as those in the first and second embodiments.

The actuator 102 in this embodiment is formed in a rhomboid shape having a width of about 170 μm and length of about 340 μm. The diameter of the nozzle 101 can be set to about 20 μm. The cross-section of the ink pressure chamber 201 is also a rhomboid shape according to the shape of the actuator 102.

Compared with the circular piezoelectric film pattern, it is possible to arrange a piezoelectric pattern at higher density.

The several embodiments of the present invention are explained above. However, these embodiments are presented as examples and are not intended to limit the scope of the invention. These new embodiments can be carried out in other various forms. Various kinds of omission, replacement, and change can be performed without departing from the spirit of the invention. These embodiments and modifications thereof are included in the scope and the spirit of the invention and include in the inventions described in claims and a scope of equivalents of the inventions.

What is claimed is:

1. An inkjet head, comprising:

a nozzle through which ink is ejected;

an ink pressure chamber for supplying ink to the nozzle;

an oscillating plate, fluidly communicated with the ink pressure chamber, which surrounds the nozzle and has a first opening having a first diameter;

a first electrode, disposed on the oscillating plate at a side opposite to the ink pressure chamber with respect to the oscillating plate, which surrounds the nozzle and has a second opening having a second diameter larger than the first diameter;

a piezoelectric layer, contacting the first electrode, which surrounds the nozzle, has a third opening having a third diameter larger than the first diameter, and deforms the oscillating plate in a convex shape or a concave shape in response to an electric field to expand or contract the ink pressure chamber;

a second electrode, contacting the piezoelectric layer, which surrounds the nozzle and has a fourth opening having a fourth diameter larger than the first diameter;

an inorganic layer which covers the second electrode and has a fifth opening having a fifth diameter smaller than the second, third, and fourth diameters; and a passivation layer which is made of resin and disposed on the oscillating plate at a side opposite to the ink pressure chamber to cover the entire piezoelectric layer.

2. The inkjet head according to claim 1, wherein a Young's modulus of the oscillating plate and a Young's modulus of the passivation layer are different from one another.

3. The inkjet head according to claim 1, wherein the nozzle is arranged in plural, and the first electrode is an individual electrode configured to eject ink through each nozzle.

4. The inkjet head according to claim 3, wherein each of the first electrodes includes:

an electrode terminal to which a driving signal is externally supplied;

a wiring electrode electrically connected to the electrode terminal; and an actuator electrode covering the piezoelectric layer at an end of the wiring electrode.

5. The inkjet head according to claim 1, wherein the passivation layer is formed of an insulating material.

6. The inkjet head according to claim 1, further comprising an insulating layer which electrically insulates the first electrode from the second electrode and is made thinner than the piezoelectric layer.

7. The inkjet head according to claim 1 further including:

a sixth opening, located in the passivation layer, which surrounds the nozzle, wherein the first, second, third, fourth, fifth and sixth openings respectively are concentric with the nozzle.

8. A method of manufacturing an inkjet head, comprising:

forming an oscillating plate on a substrate;

forming a first electrode on the oscillating plate, and processing the first electrode to form a first opening having a first diameter;

forming a piezoelectric layer on the oscillating plate and the first electrode, and processing the piezoelectric layer to form a second opening concentric with the first opening, the second opening having a second diameter;

forming a second electrode on the oscillating plate and the piezoelectric layer, and processing the second electrode to form a third opening concentric with the first opening, the third opening having a third diameter;

forming an inorganic layer which covers the second electrode and has a fourth opening having a fourth diameter smaller than the first, second, and third diameters;

forming a passivation layer on the oscillating plate and the second electrode, and processing the passivation layer to form a fifth opening concentric with the first opening, the fifth opening having a fifth diameter;

processing the oscillating plate to form a sixth opening concentric with the first opening, the sixth opening having a sixth diameter; and forming a hole in the substrate from a side opposite to the oscillating plate with respect to the substrate to form an ink pressure chamber communicating with the sixth opening, wherein the piezoelectric layer deforms the oscillating plate in a convex shape or a concave shape in response to an electric field to expand or contract the ink pressure, wherein the passivation layer covers the entire piezoelectric layer, and wherein the first, second, third, and fourth diameters are larger than the sixth diameter.

* * * * *